US009545735B2

(12) United States Patent
Cervoni et al.

(10) Patent No.: US 9,545,735 B2
(45) Date of Patent: Jan. 17, 2017

(54) METHODS FOR DRYING CERAMIC GREENWARE USING AN ELECTRODE CONCENTRATOR

(75) Inventors: Ronald A Cervoni, Corning, NY (US); James Anthony Feldman, Campbell, NY (US); Michelle Yumiko Ronco, Horsehead, NY (US)

(73) Assignee: Corning Incorporated, Corning, NY (US)

( * ) Notice: Subject to any disclaimer, the term of this patent is extended or adjusted under 35 U.S.C. 154(b) by 2576 days.

(21) Appl. No.: 12/195,002

(22) Filed: Aug. 20, 2008

(65) Prior Publication Data

US 2010/0043248 A1 Feb. 25, 2010

(51) Int. Cl.

| | |
|---|---|
| ***F26B 3/347*** | (2006.01) |
| ***H05B 6/00*** | (2006.01) |
| ***H05B 6/50*** | (2006.01) |
| ***H05B 6/60*** | (2006.01) |
| ***B28B 11/24*** | (2006.01) |
| ***F26B 15/12*** | (2006.01) |

(52) U.S. Cl.

CPC ..... *B28B 11/243* (2013.01); *B28B 11/241* (2013.01); *F26B 3/347* (2013.01); *F26B 15/12* (2013.01); *F26B 2210/02* (2013.01)

(58) Field of Classification Search

CPC ..... H05B 6/60; H05B 6/50; B28B 11/241; B28B 11/243; F26B 15/12; F26B 3/347; F26B 2210/02

USPC ... 219/750, 701, 709, 776, 779; 34/254, 255

See application file for complete search history.

(56) References Cited

U.S. PATENT DOCUMENTS

| | | | | | |
|---|---|---|---|---|---|
| 2,872,558 | A | * | 2/1959 | Price | 219/532 |
| 3,446,929 | A | * | 5/1969 | Smith | 219/696 |
| 3,452,176 | A | * | 6/1969 | Levinson | 219/759 |
| 3,469,053 | A | * | 9/1969 | Levinson | 219/746 |
| 3,569,657 | A | * | 3/1971 | Levinson | 219/762 |
| 3,935,415 | A | * | 1/1976 | Moore | 219/750 |
| 3,985,946 | A | * | 10/1976 | Werych | 373/128 |
| 4,104,804 | A | * | 8/1978 | Sargeant | 34/262 |
| 4,177,035 | A | * | 12/1979 | Buschermohle | 432/121 |
| 4,321,042 | A | * | 3/1982 | Scheicher | 433/201.1 |
| 4,439,929 | A | * | 4/1984 | Kitagawa et al. | 34/254 |
| 4,567,340 | A | * | 1/1986 | Latchum, Jr. | 219/701 |

(Continued)

*Primary Examiner* — Eric Stapleton

(74) *Attorney, Agent, or Firm* — Charles A. Greene; Joseph M. Homa

(57) ABSTRACT

Methods for drying ceramic greenware in a manner that substantially compensates for otherwise non-uniform drying are disclosed. The methods generally include partially drying a piece (22) of greenware such that its end portions (22E) are drier than its middle portion (22C). The method also includes further drying the piece with radio-frequency (RF) radiation (88) generated by an electrode system (130) by conveying the piece through the electrode system. The electrode system has a main planar electrode (131E) with a longitudinal axis ($A_E$), and an electrode concentrator (131C) formed thereon or attached thereto. The electrode concentrator has a central section (140) that runs in the direction of the longitudinal axis of the electrode and is configured so that when the piece is conveyed through the electrode system, the electrode system concentrates more RF radiation at the center portion of the piece than at the end portions of the piece.

14 Claims, 7 Drawing Sheets

(56) References Cited

U.S. PATENT DOCUMENTS

| | | | | | |
|---|---|---|---|---|---|
| 4,687,895 | A * | 8/1987 | Chitre et al. | 219/701 |
| 4,771,153 | A * | 9/1988 | Fukushima et al. | 219/709 |
| 4,806,718 | A * | 2/1989 | Seaborne et al. | 219/730 |
| 4,808,780 | A * | 2/1989 | Seaborne | 219/730 |
| 4,965,427 | A * | 10/1990 | Seaborne | 219/759 |
| 4,968,865 | A * | 11/1990 | Seaborne et al. | 219/759 |
| 5,098,620 | A * | 3/1992 | Bradley et al. | 264/432 |
| 5,110,216 | A * | 5/1992 | Wickersheim et al. | 374/122 |
| 5,183,787 | A * | 2/1993 | Seaborne | 501/143 |
| 5,194,268 | A * | 3/1993 | Bradley et al. | 425/84 |
| 5,227,600 | A * | 7/1993 | Blake et al. | 219/762 |
| 5,263,263 | A * | 11/1993 | Gheorghiu et al. | 34/250 |
| 5,388,345 | A * | 2/1995 | Brundage et al. | 34/256 |
| 5,560,287 | A * | 10/1996 | Petelle et al. | 99/451 |
| 5,808,282 | A * | 9/1998 | Apte et al. | 219/679 |
| 5,911,941 | A * | 6/1999 | Rokhvarger et al. | 264/432 |
| 5,961,871 | A * | 10/1999 | Bible et al. | 219/709 |
| 6,097,019 | A * | 8/2000 | Lewis et al. | 219/750 |
| 6,104,005 | A * | 8/2000 | Adamski et al. | 219/409 |
| 6,132,671 | A * | 10/2000 | Beall et al. | 264/630 |
| 6,157,014 | A * | 12/2000 | Goranson | 219/700 |
| 6,172,346 | B1 * | 1/2001 | Wroe | 219/681 |
| 6,222,170 | B1 * | 4/2001 | Tucker et al. | 219/748 |
| 6,246,040 | B1 * | 6/2001 | Gunn | 219/771 |
| 6,281,469 | B1 * | 8/2001 | Perrin et al. | 219/121.43 |
| 6,382,964 | B2 * | 5/2002 | Sakamoto et al. | 432/171 |
| 6,462,320 | B1 * | 10/2002 | Fuls et al. | 219/700 |
| 6,539,644 | B1 * | 4/2003 | Araya | 34/259 |
| 6,717,120 | B2 * | 4/2004 | Fritts et al. | 219/700 |
| 6,725,567 | B2 * | 4/2004 | Yano et al. | 34/419 |
| 7,208,710 | B2 * | 4/2007 | Gregoire et al. | 219/697 |
| 8,207,479 | B2 * | 6/2012 | Ben-Shmuel et al. | 219/746 |
| 8,224,892 | B2 * | 7/2012 | Bogatin et al. | 709/203 |
| 2002/0047009 | A1 * | 4/2002 | Flugstad et al. | 219/771 |
| 2002/0084555 | A1 * | 7/2002 | Araya et al. | 264/430 |
| 2002/0179596 | A1 * | 12/2002 | Tracy et al. | 219/687 |
| 2003/0205571 | A1 * | 11/2003 | Flugstad et al. | 219/497 |
| 2004/0240817 | A1 * | 12/2004 | Hawtof et al. | 385/125 |
| 2005/0187094 | A1 * | 8/2005 | Hayashi | 501/127 |
| 2005/0261795 | A1 * | 11/2005 | Ghosh et al. | 700/118 |
| 2007/0079534 | A1 * | 4/2007 | Lukas et al. | 38/93 |
| 2007/0184190 | A1 * | 8/2007 | Hiramatsu et al. | 427/249.1 |
| 2007/0235450 | A1 * | 10/2007 | Quantrille et al. | 219/730 |
| 2007/0295716 | A1 * | 12/2007 | Quantrille et al. | 219/678 |
| 2008/0023886 | A1 * | 1/2008 | Adrian et al. | 264/489 |
| 2008/0258348 | A1 * | 10/2008 | Feldman et al. | 264/432 |
| 2008/0303181 | A1 * | 12/2008 | Holand et al. | 264/16 |
| 2009/0139976 | A1 * | 6/2009 | Lee | 219/400 |
| 2010/0043248 | A1 * | 2/2010 | Cervoni et al. | 34/254 |

* cited by examiner

METHODS FOR DRYING CERAMIC GREENWARE USING AN ELECTRODE CONCENTRATOR

FIELD

The present invention relates to ceramic greenware, and in particular relates to systems and methods for ceramic greenware drying during manufacture using an electrode concentrator.

BACKGROUND

As used herein, ceramic greenware, or greenware, refers to bodies comprised of ceramic-forming components that form ceramic bodies when fired at high temperature. The greenware may include ceramic components such as a mixture of various ceramic-forming components and a ceramic component. The various components can be mixed together with a liquid vehicle, such as water, and extruded with a formed shape such as a honeycomb structure. Immediately after extrusion, the greenware contains some water, and typically at least some of the water must be removed and the greenware must be dried prior to firing at high temperature, which forms a refractory material.

In certain instances, the greenware is sometimes not evenly dried. This is particularly true in certain two-step drying process wherein the first drying step causes some drying unevenness and the second step cannot compensate for this unevenness. Uneven drying leads to production losses. There is therefore a need for systems and methods to accomplish uniform (even) drying of extruded ceramic greenware.

SUMMARY

One aspect of the invention is a method of drying a piece of ceramic greenware having opposite end portions and a center portion in between and comprising a liquid at an initial liquid content. The method includes exposing the piece to electromagnetic radiation at a first frequency so as to heat the end portions more than the center portion. The method also includes exposing the piece to electromagnetic radiation at a second frequency different from the first frequency so as to heat the center portion of the piece more than the end portions.

Another aspect of the invention is a method of drying a piece of ceramic greenware having opposite end portions and a center portion in between and comprising a liquid at an initial liquid content. The method includes partially drying the piece such that the end portions are drier than the middle portion. The method also includes further drying the piece with radio-frequency (RF) radiation generated by an electrode system by conveying the piece past the electrode system. The electrode system has a central section configured to concentrate more RF radiation at the center portion of the piece than at the ends of the piece when the piece is conveyed through the electrode system.

Another aspect of the invention is a method of drying a piece of ceramic greenware having opposite end portions and a center portion in between and comprising a liquid at an initial liquid content. The method includes exposing the piece to electromagnetic radiation at a first frequency so as to heat at least one of the end portions to a first end temperature greater than a first center temperature in the center portion. The method also includes exposing the piece to electromagnetic radiation at a second frequency different from the first frequency so as to heat the center portion to a second center temperature that is higher than the first center temperature.

Another aspect of the invention is a method of drying a piece of ceramic greenware having a center portion and opposite end portions and comprising water at an initial water content. The method includes performing a first exposure of the piece with first electromagnetic radiation so as to remove a first portion of the water more from the opposite end portions of the piece than from the center portion of the piece. The method also includes performing a second exposure of the piece with second electromagnetic radiation so as to remove a second portion of the liquid more from the center portion of the piece than from the end portions of the piece.

These and other advantages of the invention will be further understood and appreciated by those skilled in the art by reference to the following written specification, claims and appended drawings.

DETAILED DESCRIPTION

Reference is now made in detail to the embodiments of the invention, examples of which are illustrated in the accompanying drawings. Whenever possible, the same or similar reference numbers and symbols are used throughout the drawings to refer to the same or similar parts.

Ceramic greenware can be formed by extruding a plasticized batch comprising ceramic-forming components, or ceramic precursors, through a die, such as a die that produces a honeycomb structure, to form an extrudate of the ceramic-forming material. The extrudate that exits the extruder is cut transversely to the direction of extrusion to form a greenware piece. The piece may itself be transversely cut into shorter pieces; in some cases, the longer piece is referred to as a "log." Extruded pieces of greenware contain water (for example, 10-25% by weight), and the greenware needs to be dried prior to forming the final product.

The greenware is typically placed on trays or supports and then sent through an oven or "applicator." Microwave (MW) applicators apply microwave radiation. As used herein, microwave radiation corresponds to electromagnetic radiation in the frequency range from about 900 MHz to about 2500 MHz. RF (radio-frequency) applicators apply RF radiation. As used herein, RF radiation corresponds to electromagnetic radiation in the frequency range of about 27 MHz to about 35 MHz. Both MW and RF radiation are absorbed by the greenware, albeit to different extents in some cases. Water can thus be driven off by either form of radiation, leaving a dry (or drier) piece of greenware.

The greenware can be made up of material(s) transparent to MW and RF radiation as well other materials that are not, i.e. MW-susceptible materials such as graphite, as found, for example, in at least some batches and greenware that form aluminum titanate or "AT". Greenware containing MW-susceptible material is more prone to the occurrence of hot spots during drying.

The systems and methods disclosed herein reduce the occurrence and/or intensity of non-uniform heating and drying that result from drying the greenware to the extent that is sufficient for preparing the greenware for firing at high temperature. Certain known drying methods include, for example, a first MW drying step and a second RF drying step. However, even if the overall moisture content of a piece of greenware is substantially reduced in a first drying step, the non-uniformity of the heating and drying that results generally prevents uniform heating and drying from occurring in the second drying step. Attempting to dry the greenware further in the second step without accounting for the non-uniform heating and drying of the first drying step can produce cracks in the piece.

Figure 1A:
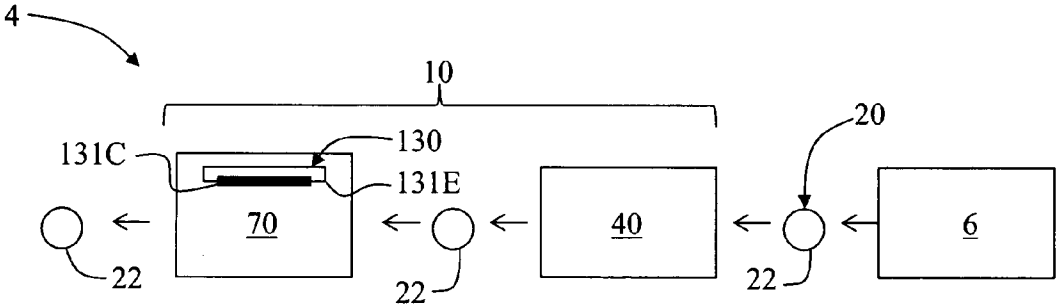
FIG. 1A is a schematic diagram of an example ceramic greenware-forming system that includes an extruder followed by a two-step drying system that includes a microwave (MW) applicator and a RF applicator with an electrode system.

FIG. 1A is a schematic diagram of an exemplary greenware-forming system 4 that includes an extruder 6 followed by a drying system 10 that includes a MW dryer or "applicator" 40 followed by a RF dryer or "applicator" 70 that includes an electrode system 130. Electrode system 130 includes a main electrode 131E and an electrode concentrator 131C and is discussed in greater detail below. FIG. 1A illustrates an example of a "two-step" drying system 10 that uses both MW radiation and RF radiation in sequence to dry pieces 22 of extruded greenware 20.

Figure 1B:
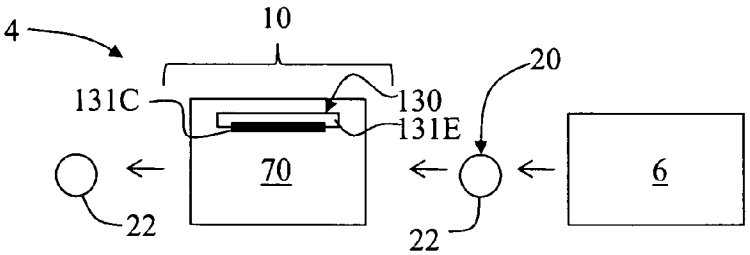
FIG. 1B is a schematic diagram of a greenware-forming system similar to that of FIG. 1A, but that has a one-step drying system having just the RF applicator of FIG. 1A.

FIG. 1B is a schematic diagram of a greenware-forming system 4 similar to that of FIG. 1A, but that shows a drying system 10 having just the RF applicator 70 of FIG. 1A. Such a drying system is referred to as a "one-step" drying system.

Figure 1C:
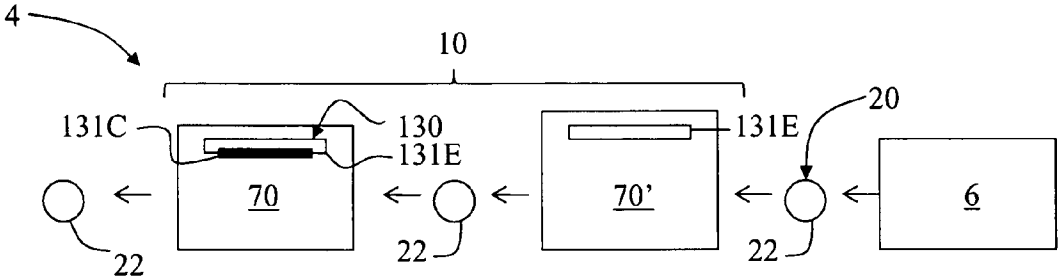
FIG. 1C is a schematic diagram of a greenware-forming system similar to that of FIG. 1A, but that shows a two-step drying system that includes first and second RF applicators, wherein the first RF applicator has only a planar electrode, and the second RF applicator has an electrode system according to the present invention.

FIG. 1C is a schematic diagram of a greenware-forming system 4 similar to that of FIG. 1A, but that shows a two-step drying system 10 that includes first and second RF applicators 70' and 70, wherein the first RF applicator 70' has just main electrode 131E and the second RF applicator 70 has the entire electrode system 130.

The present invention can be practiced with various types of greenware-forming systems 4, including one-step and two-step systems such as those shown in FIGS. 1A-1C. By way of illustration, the present invention is now discussed in the context of the two-step drying system 10 of FIG. 1A. Applications of the present invention to the other types of drying systems 10, such as those in FIGS. 1B and 1C, are also discussed below.

Two-Step Drying System

Figure 2:
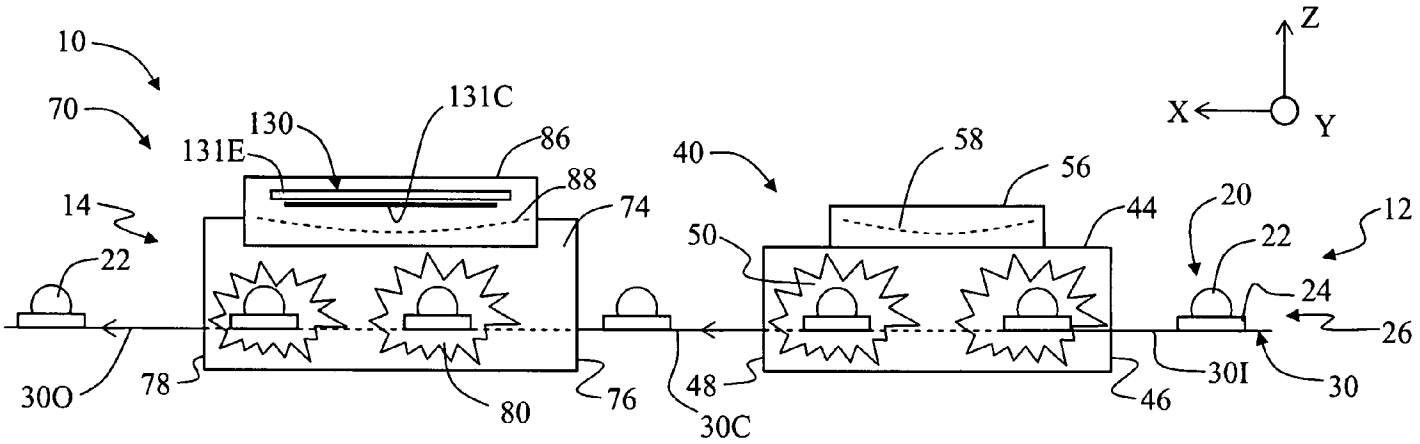
FIG. 2 is a detailed schematic side view of an example of the two-step drying system of FIG. 1A for performing a two-step drying process on the extruded greenwares.
Figure 3:
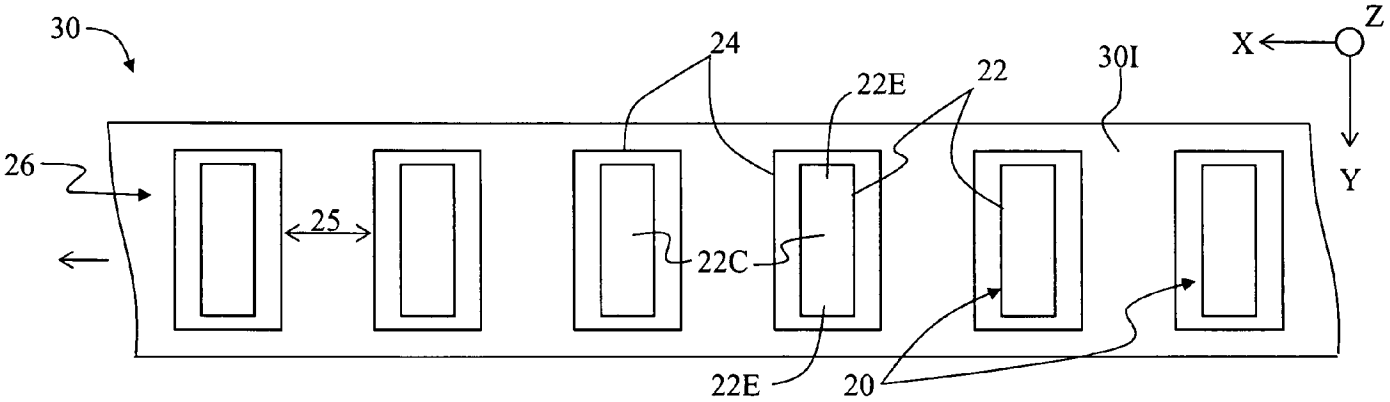
FIG. 3 is a close-up top-down view of the two-step drying system of FIG. 2.

FIG. 2 is a detailed schematic side view of an example of the two-step drying system of FIG. 1A for performing a two-step drying process. FIG. 3 is a top-down view of the two-step drying system 10 of FIG. 2. The two-step drying system 10 of FIG. 1A, FIG. 2 and FIG. 3 performs a two-step drying process using electromagnetic radiation of two different frequencies (MW and RF) to dry pieces 22 supported in trays 24. Pieces 22 each have opposite end portions 22E with a center portion 22C in between.

When extruder 6 (see FIG. 1A) initially extrudes pieces 22, they contain water (e.g., 10-25% by weight) and therefore need to be dried. Pieces 22 can be generally cylindrical and have a length of 15", 25" or 32" and a diameter of about 5" in exemplary embodiments, although other sizes and shapes can be accommodated. For example, 12" long square-cross-section pieces ("loggettes") or oval-cross-section logs are sometimes used that have a 4" minor axis and an 8" major axis. The greenware 20 can be manufactured by using extruder 6 to extrude ceramic-forming material, cutting the extrudate into pieces 22 and then performing drying and firing steps. After firing, the greenware 20 transforms into a body comprising ceramic material, such as cordierite, and has a honeycomb structure with thin interconnecting porous walls that form parallel cell channels that longitudinally extend between opposite end faces.

Other exemplary ceramic bodies are comprised of ceramic materials that include aluminum titanate (AT). Such AT-based bodies are used as an alternative to cordierite and silicon carbide (SiC) bodies for high-temperature applications such as automotive emissions control applications. The systems and methods disclosed herein apply to any type of greenware 20 capable of being dried utilizing RF techniques.

With continuing reference to FIG. 2 and FIG. 3, drying system 10 has an input end 12 and an output end 14. Cartesian coordinates are shown for the sake of reference, with the Y-axis pointing out of the paper. Pieces 22 in trays 24 are conveyed in a greenware queue 26 along a conveyor system 30 having one or more conveyor sections, namely an input section 301, a central section 30C and an output section 30O. Pieces 22 are conveyed in the X direction by conveyor system 30 so that they travel sequentially through MW applicator 40 and then RF applicator 70.

MW applicator 40 includes a housing 44 with an input end 46, an output end 48, an interior 50, and a MW source 56 that generates microwave radiation (i.e., MW radiation or "microwaves") 58 of frequency $f_{MW}$. RF applicator 70 includes a housing 74 with an input end 76, an output end 78, an interior 80, and a RF source 86 that generates radio waves (or "RF energy" or "RF radiation") 88 of frequency $f_{RF}$ in electrode system 130.

In the general operation of drying system 10, cut pieces 22 of greenware 20 extruded from extruder 6 (FIG. 1) are placed in trays 24 and conveyed via input conveyor section 301 to drying system input end 12. Pieces 22 are preferably aligned at input end 12 and then conveyed into interior 50 of MW applicator 40 where they are exposed to MW radiation 58 as they pass underneath MW source 56. In an example embodiment, MW radiation 58 and the time over which pieces 22 are exposed to the MW radiation are selected so that the piece is partially but not completely dried upon leaving MW applicator 40 at its output end 48. By completely dried, we mean the moisture content has been reduced to a level acceptable such that the piece can be fired at high temperature in order to form the ceramic material that makes up the ceramic body. In an example embodiment, pieces 22 are about 75% dry upon leaving MW applicator 40. In respective example embodiments, MW applicator 40 dries pieces 22 more than about 50 wt % and more than about 75 wt %. In an another example embodiment, pieces 22 contain more than about 10 wt % water upon exiting MW applicator 40.

Pieces 22 are then conveyed to input end 76 of RF applicator 70 via central conveyor section 30C and enter interior 80, where they are exposed to RF radiation 88 as they pass underneath electrode system 130 of RF source 86. The partially dried pieces 22 that enter RF applicator 70 are substantially (i.e., completely or nearly completely) dried when they exit the RF applicator at exit end 78 via an output conveyor section 30O. Upon exiting RF applicator 70, pieces 22 contain less than about 2 wt % water in an one example embodiment and less than about 1% water in another example embodiment.

In the two-step drying process considered herein, only partial drying of pieces 22 is performed by exposing the pieces to MW radiation 58. Pieces 22 are not completely dried using MW applicator 40 because MW drying can cause "hot spots" to form on the greenware that can damage the piece. This is particularly true for greenware that contains a microwave-susceptible material such as graphite. In addition, MW radiation 58 does not penetrate ceramic-based greenware 20 as deeply as RF radiation.

Consequently, we have found it beneficial to use a two-step drying process wherein pieces 22 are only partially dried using MW radiation 58 and then substantially completely dried using RF radiation 88.

We also discovered that when a prior art RF applicator 70 was used in two-step drying system 10, partially dried pieces 22 made from AT with a graphite poreformer (the combination having a dry dielectric constant>5 and a dry Loss Factor>2) that exited from MW applicator 40 were not uniformly dried when they were subsequently further dried in RF applicator 70. In particular, it was found that end portions 22E of such pieces 22 were heated more than their center portions 22C so that the end portions were drier than the center portions.

In addition, the overall "percent dryness" was found in certain instances to be between 90% to 93% as compared to a required overall dryness of 98% or greater. The non-uniform drying of pieces 22 during RF drying resulted in pieces that did not meet this specification. This, in turn, reduced the throughput of the two-step drying system 10, leading to increased production costs, product costs, and diminished process stability.

RF Electrode System with Concentrator

The above-described problems with non-uniform RF drying led us to develop a modification to RF source 86—and in particular to electrode system 130—such that RF applicator 70 can compensate for the non-uniform drying of the MW applicator 40 so that the two-step process can achieve substantially uniform drying. It is noted here that the modification to electrode system 130 allows for compensating any greenware-drying process that otherwise introduces drying non-uniformities or that results in drying unevenness.

Figure 4:
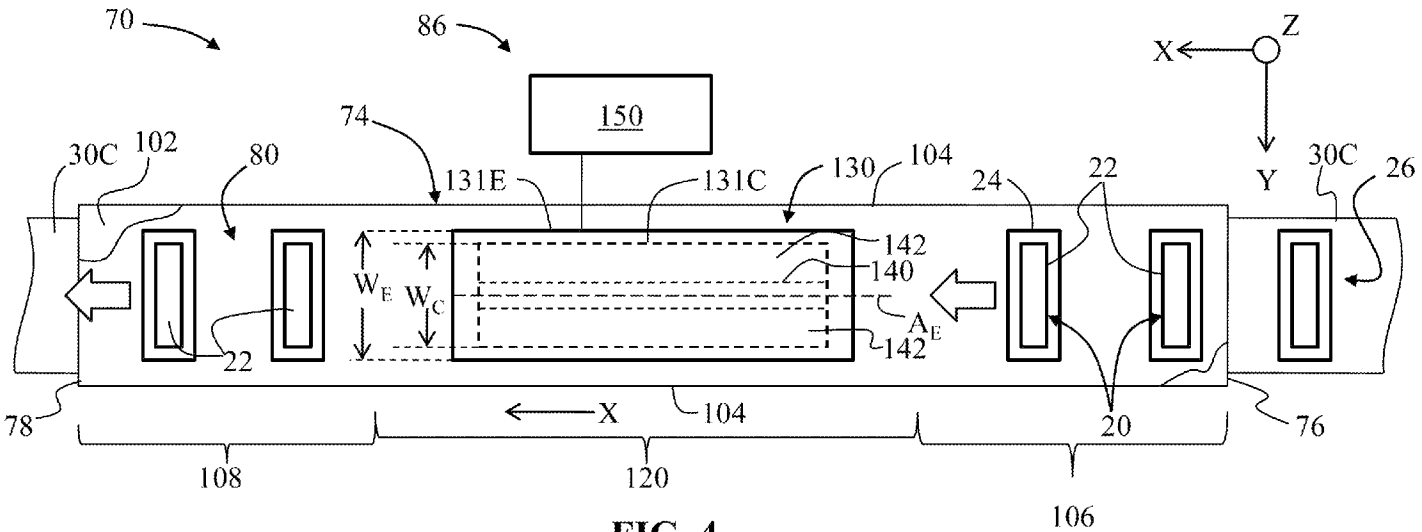
FIG. 4 is a schematic top-down view of an example embodiment of a RF applicator that includes an electrode system that includes an electrode concentrator in accordance with the present invention.
Figure 5:
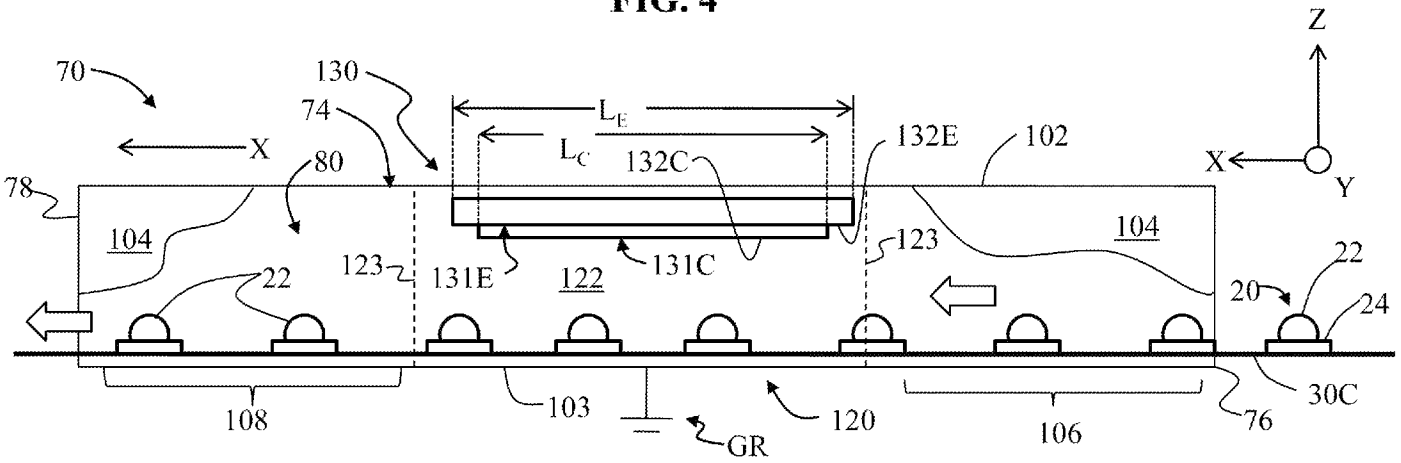
FIG. 5 is a schematic side view of the RF applicator of FIG. 4.

FIG. 4 is a schematic top-down view of an example embodiment of RF applicator 70 that utilizes a RF source 86 wherein electrode system 130 includes the aforementioned main electrode 131E and electrode concentrator 131C. FIG. 5 is a schematic side view of the RF applicator 70 of FIG. 4 and shows an example arrangement of main electrode 131E and electrode concentrator 131C. Main electrode 131E has a longitudinal axis $A_E$ and a lower (proximate) surface 132E on which electrode concentrator 131C is formed or to which the electrode concentrator is attached. Electrode concentrator 131C includes a proximate surface 132C. Electrode system 130 is electrically connected to a control unit 150 that controls the operation of RF applicator 70. An example control unit 150 is shown in FIG. 6 and is discussed in more detail below.

With continuing reference to FIG. 5, housing 74 of RF applicator 70 includes a top 102, a bottom 103 and sides 104. RF applicator 70 includes an entrance portion or "entrance vestibule" 106 at input end 76 and an exit portion or "exit vestibule" 108 at output end 78. Entrance and exit vestibules 106 and 108 lead to a central region 120 that includes electrode system 130 arranged within interior 80 adjacent to and spaced apart from (e.g., by about 4 feet) housing top 102. In an example embodiment, entrance and exit vestibules 106 and 108 are about 8 feet in length.

Figure 6:
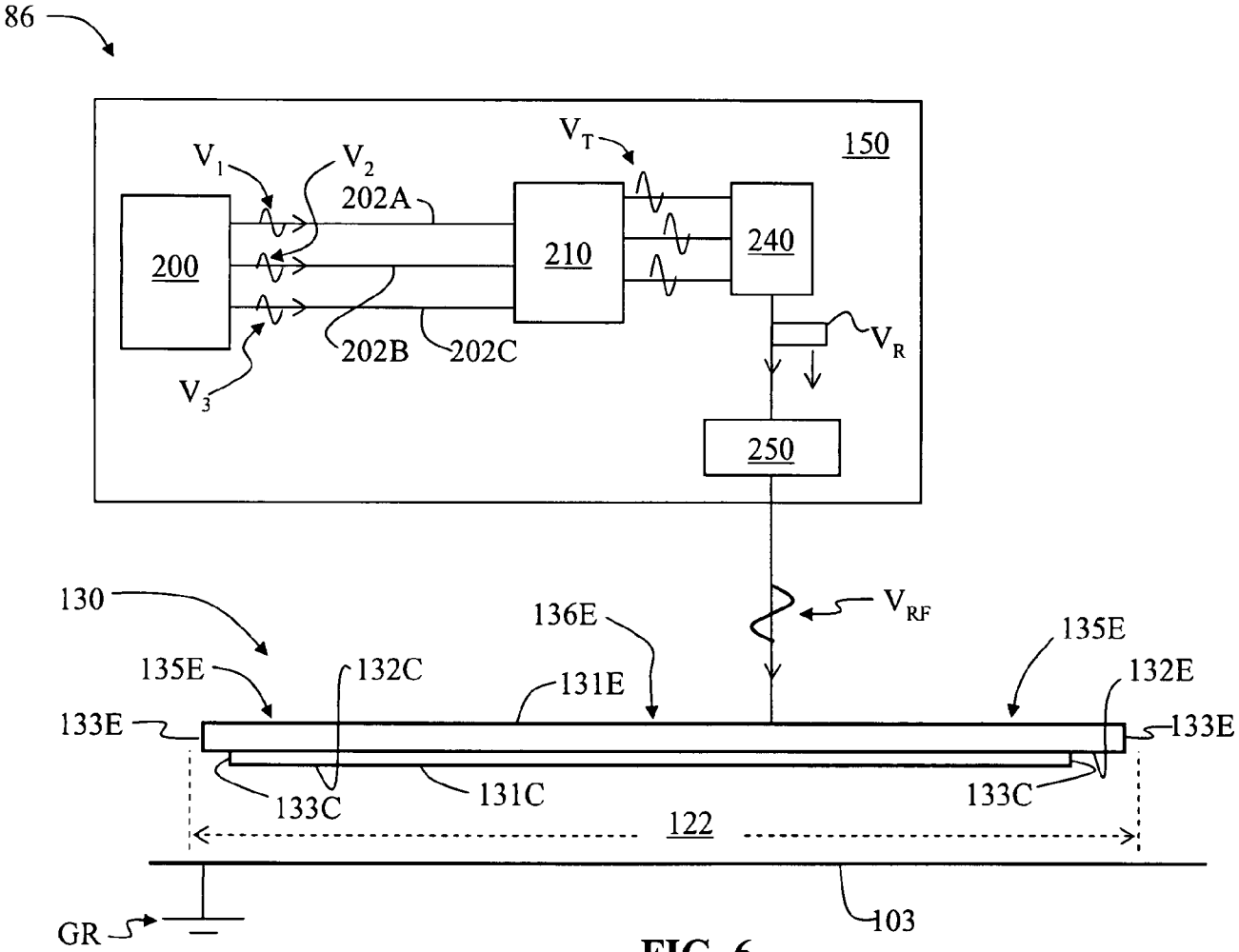
FIG. 6 is a schematic diagram of an example embodiment of the RF source of FIG. 4 that includes a control unit configured to provide a RF voltage $V_{RF}$ to the electrode system.

In an example embodiment as illustrated in FIG. 6, main electrode 131E is planar and rectangular, and has ends 133E, sides 134E, opposite end sections 135E that include the respective ends, and a central section 136E centered around longitudinal axis $A_E$ and that resides in between the opposite ends. Main electrode 131E has a length $L_E$ (measured along longitudinal axis $A_E$) and a width $W_E$ as measured perpendicular to the main electrode longitudinal axis. In an example embodiment, $L_E$=15 feet and $W_E$=4 feet. Electrode concentrator 131C has a lower surface 132C, ends 133C, sides 134C, a length $L_C$, and a width $W_C$. Example dimensions for electrode concentrator 131C are discussed below.

A portion of bottom 103 of housing 74 directly beneath electrode system 130 is electrically grounded via electrical ground GR and serves as a "bottom electrode" that forms—with main electrode 131E and electrode concentrator 131C—a large capacitor in central region 120.

Control unit 150 is configured to provide a RF-frequency AC voltage signal $V_{RF}$ ("RF voltage") to electrode system 130. This results in a RF-varying electric field that is substantially contained within a sub-region 122 ("electrode region") of central region 120 underneath electrode system 130. Electrode region 122 has a length essentially the same as main electrode length $L_E$ as indicated by vertical dashed lines 123. Electrode region 122 is where the RF drying of pieces 22 takes place.

In an example embodiment, control unit 150 is operably coupled to and controls the operation of central conveyor section 30C. FIG. 6 is a schematic diagram of an example embodiment of RF source 86 illustrating an example configuration for control unit 150 that provides the RF voltage $V_{RF}$ to electrode system 130. Control unit 150 includes a three-phase power supply 200 (e.g., 480V AC) with three output lines 202A, 202B and 202C that carry initial AC voltages $V_1$, $V_2$ and $V_3$ provided directly to a step-up transformer 210. Step-up transformer 210 steps up the voltage provided thereto by input voltages $V_1$, $V_2$ and $V_3$ to form an AC transformer output voltage $V_T$. The transformer output voltage $V_T$ is fed to a rectifier 240, which rectifies the AC voltage $V_T$ to form DC plate voltage $V_R$. Plate voltage $V_R$ is provided to a DC/AC converter 250, which converts this DC voltage into the high-frequency AC RF voltage $V_{RF}$. In an example embodiment, DC/AC converter 250 is an oscillator circuit that includes an oscillator tube (not shown).

It is noted here that one or more of the components of controller unit 150 can reside outside of the controller unit and are shown included within the controller unit for the sake of illustration. In an example embodiment, DC/AC converter 250 is a high-frequency DC/AC converter. In the example embodiment of control unit 150, the input voltages $V_1$, $V_2$ and $V_3$ are equal and the output voltage $V_T$ is cycled between output lines 202A, 202B and 202C.

Electrode Concentrator

Figure 7:
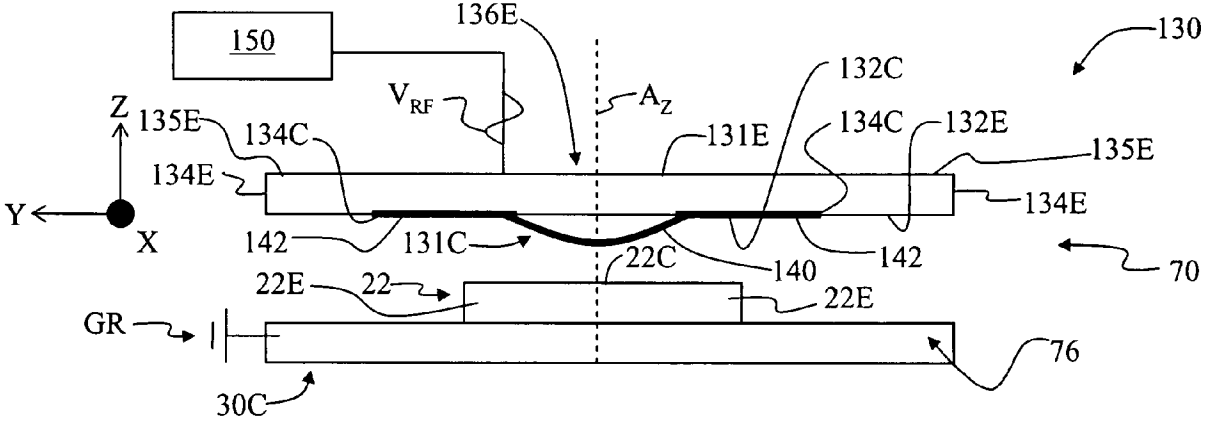
FIG. 7 is a close-up end-on view of the input end of the RF applicator of FIG. 4 and FIG. 5, showing an example cross-sectional shape for the electrode concentrator.
Figure 8A:
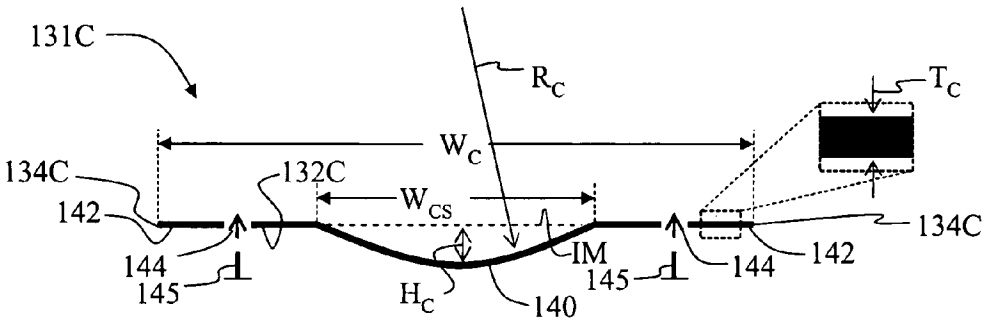
FIG. 8A is a close-up end-on view of the electrode concentrator of FIG. 7, illustrating an example method of attaching a U-shaped electrode concentrator to the main planar electrode.
Figure 8B:
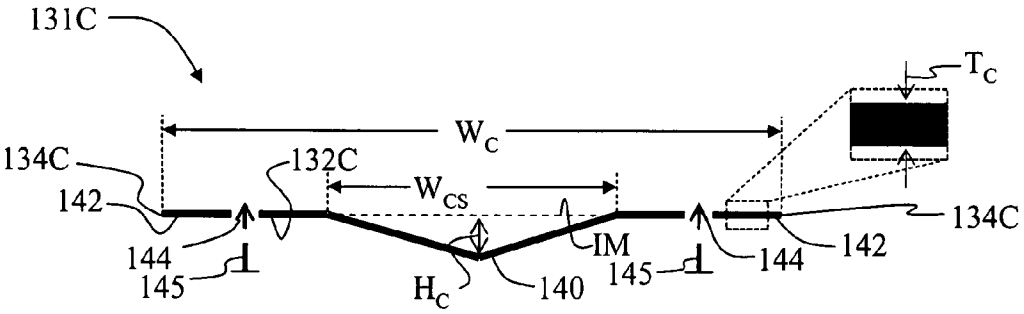
FIG. 8B is similar to FIG. 8A, and illustrates an example embodiment of an electrode concentrator having a V-shaped cross-section.
Figure 8C:
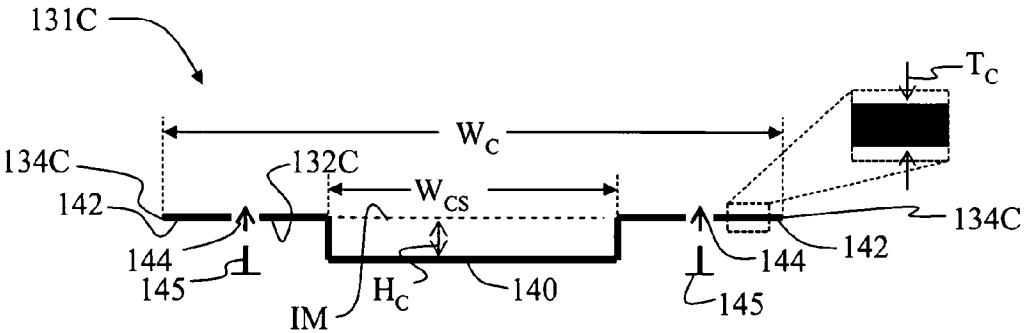
FIG. 8C is similar to FIG. 8A and illustrates an example embodiment of an electrode concentrator having a rectangular-shaped cross-section.
Figure 9:
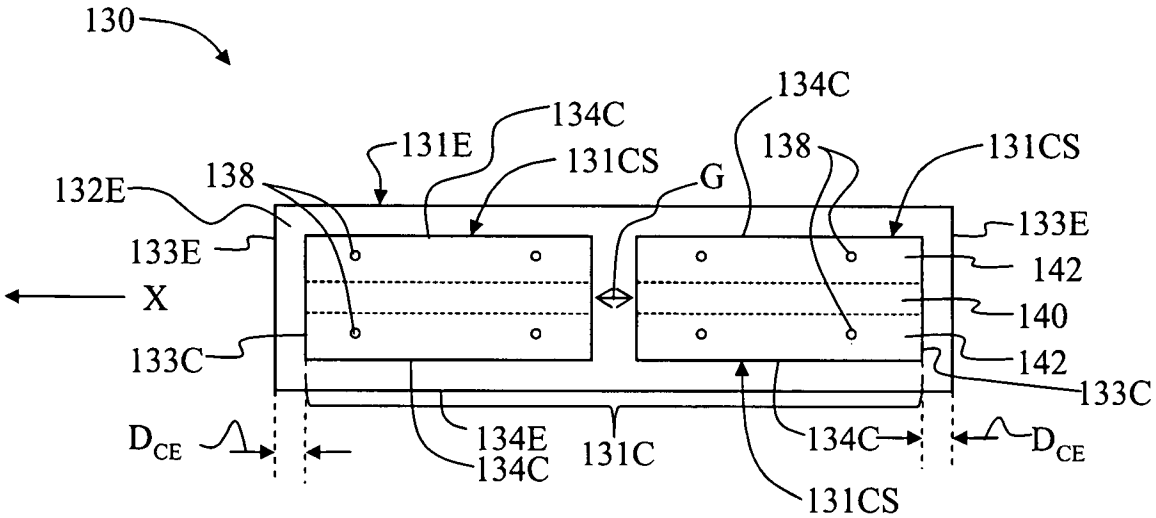
FIG. 9 is a bottom-up view of the electrode system illustrating an example embodiment wherein the electrode concentrator comprises two spaced-apart sections.

FIG. 7 through FIG. 9 show various views of main electrode 131E and electrode concentrator 131C. FIG. 7 is an end-on view of the RF applicator 70 of FIG. 6 that shows the cross-section of electrode concentrator 131C. A central axis $A_Z$ oriented in the Z-direction is shown in FIG. 7 for the sake of reference. Axis $A_Z$ is perpendicular to main electrode lower surface 132E. FIG. 8A is a close-up end-on view of an example embodiment of electrode concentrator 131C having a U-shaped cross-section. In other example embodiments, central section 140 has a V-shaped or rectangular shaped cross-section, as shown in FIGS. 8B and 8C, respectively.

In an example embodiment, electrode concentrator length $L_C$ is in the range defined by $12' \leq L_C \leq 15'$, and in a more specific example embodiment is in the range defined by $13' \leq L_C \leq 14'$. In addition, in an example embodiment, electrode concentrator width $W_C$ is in the range defined by $28'' \leq W_C \leq 36''$, and in a more specific example embodiment is in the range defined by $30'' \leq W_C \leq 34''$.

In an example embodiment, electrode concentrator 131C has a shape that is symmetric about axis $A_Z$ and includes a central section 140 that is centered on axis $A_Z$ and that runs in the direction of the electrode longitudinal axis $A_E$. In the U-shaped example embodiment of FIG. 8A, central section 140 curves outwardly relative to main electrode lower (proximate) surface 132E. An example embodiment of electrode concentrator 131C includes a flat outer section 142 on either side of curved central section 140.

As shown in FIG. 8A, central section 140 has a width $W_{CS}$ and a height $H_C$ (on axis $A_Z$) measured from an imaginary line IM connecting outer portions 142. In an example embodiment, height $H_C$ is in the range defined by $1'' \leq H_C \leq 2''$, and in a specific example embodiment is about 1.125". In an example embodiment, center section 140 is a defined as section of a circular arc having a radius $R_C$ that is in the range defined by $15'' \leq R_C \leq 25''$ and is in the range defined by $19'' \leq R_C \leq 20''$ in a particular example embodiment.

Electrode concentrator central section width $W_{CS}$ is in the range defined by $10'' \leq W_{CS} \leq 20''$ in an example embodiment, is in the ranged defined by $12'' \leq W_{CS} \leq 16''$ in a specific example embodiment, and is about 14.25" in a more specific example embodiment. Electrode concentrator 131C is made of aluminum having a thickness $T_C$ that is in the range defined by $\frac{1}{8}'' \leq T_C \leq \frac{1}{4}''$ in an example embodiment and that is about $\frac{3}{16}''$ in a specific embodiment.

In an example embodiment, a number of through-holes 144 are formed in each flat outer section 142, and electrode concentrator 131C is attached to main electrode 131E at lower surface 132E via screws or bolts 145.

Given the large size of main electrode 131E, it may be difficult to find large enough metal sheets (e.g., aluminum sheets) to form electrode concentrator 131C as a unitary structure. Thus in an example embodiment, with reference to FIG. 9, electrode concentrator 131C comprises two or more sections 131CS arranged on main electrode lower surface 132E in the X direction. In an example embodiment, the two or more electrode concentrator sections 131CS are separated by a gap G sufficient to avoid arcing between the sections. In an example embodiment, gap $G \geq 6''$. In an example embodiment, electrode concentrator 131C extends the entire length of main electrode ends 133 (i.e., $L_C = L_E$). In another example embodiment, $L_C < L_E$ so that there is a distance $D_{CE}$ between main electrode ends 133E and electrode concentrator ends 133C. In an example embodiment, $2'' \leq D_{CE} \leq 12''$.

In an example embodiment, the two or more electrode concentrator sections 131CS need not be identical. Thus, in an example embodiment, two or more electrode sections 131CS having different dimensions are used to tailor the RF drying process. For example, a first section 131CS closest to input end 76 of RF applicator 70 can have a first height $H_C$ of, for example, 1.125" and a central section width length $W_{CS}$ of, for example 12", while a second section can have a second height $H_C$ of, for example, 2" and a central section width $W_{CS}$ of, for example, 16". This configuration would provide for a slightly greater amount of heating of central portion 22C of each piece 22 and while being conveyed through the second electrode concentrator section 131CS as compared to when the piece is conveyed through the first electrode concentrator section.

In an example embodiment of the two-step drying process using RF electrode system 130 for RF drying in the second step, in the first drying step (e.g., MW radiation exposure), the piece 22 is dried so that end portions 22E of the piece have a moisture content between 10% to 30% greater than that of the center portion 22C. The second RF exposure using RF electrode system 130 is performed so that the end portions 22E and central portion 22C have moisture contents that differ by no more than 2%.

Other Drying Configurations

As discussed above in connection with FIGS. 1A-1C, the drying method of the present invention can be used in a variety of drying configurations. For example, pieces 22 can be dried in the RF-based one-step drying system 10 of FIG. 1B in situations where a flat electrode 130 in RF applicator 70 would result in uneven drying. Thus, electrode system 130 is used with electrode concentrator 131C in order to compensate for the drying unevenness, wherein the electrode concentrator has its various design parameters tailored to compensate for the particular form of the unevenness.

The drying method can also be used for a two-step RF-based drying system 10 as shown in FIG. 1C, wherein the first RF applicator 70' uses just a planar (main) electrode 131E and the second RF applicator uses electrode system 130 with electrode concentrator 131C. This is similar to the two-step drying process of FIG. 1A, except that MW applicator 40 is replaced with a conventional RF applicator 70' that causes uneven drying of piece 22 in the first drying step.

It will be apparent to those skilled in the art that various modifications to the example embodiments of the invention as described herein can be made without departing from the spirit or scope of the invention as defined in the appended claims. Thus, it is intended that the present invention covers the modifications and variations of this invention provided they come within the scope of the appended claims and the equivalents thereto.

What is claimed is:

1. A method of drying a piece of ceramic greenware having opposite end portions and a center portion in between and comprising a liquid at an initial liquid content, the method comprising:

exposing the piece to electromagnetic radiation at a first frequency so as to heat the end portions more than the center portion; and then exposing the piece to electromagnetic radiation at a second frequency different from the first frequency so as to heat the center portion of the piece more than the end portions.

2. The method of claim 1, wherein:

the first frequency of electromagnetic radiation includes a microwave-radiation frequency in the range from about 900 MHz to about 2500 MHz; and the second frequency of electromagnetic radiation includes a radio-frequency in the range from about 27 MHZ to about 35 MHz.

3. The method of claim 2, wherein said exposing the piece to electromagnetic radiation at the second frequency further comprises:

concentrating more of the second-frequency electromagnetic radiation at the center portion of the piece than at the end portions using a concentrator electrode having either a U-shaped, a V-shaped, or a rectangular-shaped cross-section.

4. The method of claim 2, wherein said exposing the piece to electromagnetic radiation at the second frequency further comprises:

providing an electrode system that resides above the piece and that has a length, a proximate surface adjacent the piece and end portions surrounding a central portion, wherein the central portion of the electrode system is disposed closer to the piece than the end portions of the electrode system when the piece passes underneath the electrode system.

5. The method of claim 4, further comprising:

providing a main planar electrode having a central section; and securing to the main planar electrode at least one metal plate having an outwardly extending portion having either a U, a V or a rectangular cross-sectional shape and that runs longitudinally along the central section of the main planar electrode.

6. The method of claim 5, wherein the at least one metal plate is made of aluminum.

7. A method of drying a piece of ceramic greenware having opposite end portions and a center portion in between, and comprising a liquid at an initial liquid content, the method comprising:

exposing the piece to electromagnetic radiation at a first frequency so as to heat at least one of the end portions to a first end temperature greater than a first center temperature in the center portion; and then exposing the piece to electromagnetic radiation at a second frequency different from the first frequency so as to heat the center portion to a second center temperature that is higher than the first center temperature.

8. The method of claim 7, wherein the second center temperature is 40° C. or greater than the first center temperature.

9. The method of claim 7, wherein said exposing the piece to electromagnetic radiation at the second frequency further comprises:

concentrating more of the second-frequency electromagnetic radiation at the center portion of the piece than at the end portions using a concentrator electrode having either a U-shaped, a V-shaped, or a rectangular-shaped cross-section.

10. A method of drying a piece of ceramic greenware having opposite end portions and a center portion in between and comprising water at an initial water content, the method comprising:

performing a first exposure by exposing the piece with first electromagnetic radiation so as to remove a first portion of the water more from the opposite end portions of the piece than the center portion of the piece;

performing a second exposure by exposing the piece with second electromagnetic radiation so as to remove a second portion of the water more from the center portion of the piece than from the end portions of the piece; and wherein the first electromagnetic radiation has a first frequency and the second electromagnetic radiation has a second frequency different from the first frequency.

11. The method of claim 10, wherein the first frequency includes a microwave frequency in the range from about 900 MHz to about 2500 MHz, and the second frequency is a radio-frequency (RF) in the range from about 27 MHz to about 35 MHz.

12. The method of claim 10, wherein the performing the second exposure further comprises:

conveying the piece underneath an electrode system having a longitudinal axis, a lower surface and an outwardly extending central portion having either a U, a V or a rectangular cross-sectional shape and that runs in the direction of the longitudinal axis along the lower surface; and providing a radio-frequency (RF) voltage to the electrode system so as to generate said second electromagnetic radiation in the RF frequency range from about 27 MHz to about 35 MHz.

13. The method of claim 12, further including forming the outwardly extending central portion by attaching a metal plate with the outwardly extending central portion to the electrode system lower surface.

14. The method of claim 13, further comprising:

in the first exposure, drying the end portions of the piece so as to have a moisture content between 10% and 30% greater than that of the center portion of the piece; and the performing of the second exposure is carried out so that the end and central portions have moisture contents that differ by no more than 2%.

* * * * *